US005445585A

United States Patent [19]

Meeker

[11] Patent Number: 5,445,585

[45] Date of Patent: Aug. 29, 1995

[54] SPRING HOUSING AND SPREADER ASSEMBLY

[75] Inventor: Paul K. Meeker, Hiram, Ohio

[73] Assignee: Lisco, Inc., Tampa, Fla.

[21] Appl. No.: 164,250

[22] Filed: Dec. 7, 1993

[51] Int. Cl.[6] ..... A63B 22/00

[52] U.S. Cl. ..... 482/69; 482/904; 297/274; D6/333

[58] Field of Search ..... 482/69, 143, 904; 297/274, 275; D8/72, 73; D6/333

[56] References Cited

U.S. PATENT DOCUMENTS

| | | | |
|---|---|---|---|
| 73,801 | 1/1868 | Hale . | |
| 178,680 | 6/1876 | Shaw . | |
| D. 336,994 | 7/1993 | Mitchell et al. | D6/333 |
| 384,512 | 6/1888 | Dillon . | |
| 641,316 | 1/1890 | Meyer . | |
| 794,484 | 7/1905 | Bowie . | |
| 955,954 | 4/1910 | Emerick . | |
| 1,055,975 | 3/1913 | Hawk . | |
| 1,126,291 | 1/1915 | Rundle . | |
| 1,215,652 | 2/1917 | Hale . | |
| 1,339,296 | 5/1920 | Sparks . | |
| 1,346,973 | 7/1920 | Padden . | |
| 1,354,907 | 10/1920 | Hopaidaszka . | |
| 1,757,423 | 5/1930 | Gerrond . | |
| 2,317,243 | 4/1943 | Anderegg . | |
| 3,314,636 | 4/1967 | McHugh . | |
| 4,844,452 | 7/1989 | Tomosky et al. | 297/274 |

*Primary Examiner*—Richard J. Apley
*Assistant Examiner*—Lynne A. Reichard
*Attorney, Agent, or Firm*—Donald R. Bahr; John E. Benoit

[57] ABSTRACT

A doorway exerciser comprising a scissor-type spring-biased clamp having opposed arms for securing the exerciser above the upper doorframe and a strap adjustable in length removably secured to the clamp and extending downwardly. The strap passes downwardly into a tube having a compression spring therein, through a slotted plate at the bottom of the spring, and returns upwardly and is secured to itself. The tube is preferably of plastic and has three equally spaced ears extending therefrom witch two parallel slots in each ear. A separate strap for each ear passes upwardly through a first slot and downwardly through the other slot in each of the ears. One end of the strap is configured so as to prevent movement through the first slot. The other end of the strap is secured to an infant seat.

4 Claims, 3 Drawing Sheets

SPRING HOUSING AND SPREADER ASSEMBLY

This invention relates generally to doorway exercisers and more specifically to doorway exercisers which use a compression spring and which may be assembled and disassembled by the user.

Current doorway exercisers, which are also known as "jumpers," use a system wherein extension springs perform the necessary resiliency for the jumping action. These springs are extension springs with looped ends. Since extension springs are subject to failure, with the resultant failure of jumping springs allowing a baby using the jumper to fall, jumpers typically have safety cords inside the spring. Further, exposed springs, typical of current jumpers, need more expensive finishes in order to approve their general appearance. The additional of end loops, safety cords, and necessary plating adds considerable expense to such a jumper.

U.S. patent application Ser. No. 08/008,024 filed Jan. 25, 1993, now U.S. Pat. No. 5,288,283, and assigned to the present assignee, discloses a doorway exerciser which uses a compression spring and a two-way support for the infant seat.

It is an object of the present invention to provide an improved doorway exerciser which uses a simple compression spring housed inside of a rigid tube, preferably plastic, and a three-way support for the seat containing the infant.

A further object of the invention is to provide a doorway exerciser which may be easily assembled and disassembled by the user so that it may be stored or any parts may be easily cleaned or replaced.

SUMMARY OF THE INVENTION

The present invention relates to an improved doorway exerciser comprising a scissor-type spring-biased clamp having opposed arms for securing the exerciser above the upper door frame. A strap is secured to the scissor-type clamp and extends downwardly therefrom. The strap then passes into a tube which contains a compression spring therein. The strap passes through a slotted plate adjacent the bottom of the spring and returns upwardly within the spring and is then secured to itself. The tube is of a rigid material. A cylindrical member fits over the tube and is restrained at the lower end of the tube. The cylindrical member includes three substantially equally spaced ears which extend outwardly therefrom, with each ear having dual slots. A flexible strap passes through the dual slots in each of the ears and is secured at one end to the ear. Each strap terminates at the other end in a further loop, with these loops removably secured to slotted plates on the underside of an infant seat support.

DETAILED DESCRIPTION OF THE PREFERRED EMBODIMENT

Figure 1:
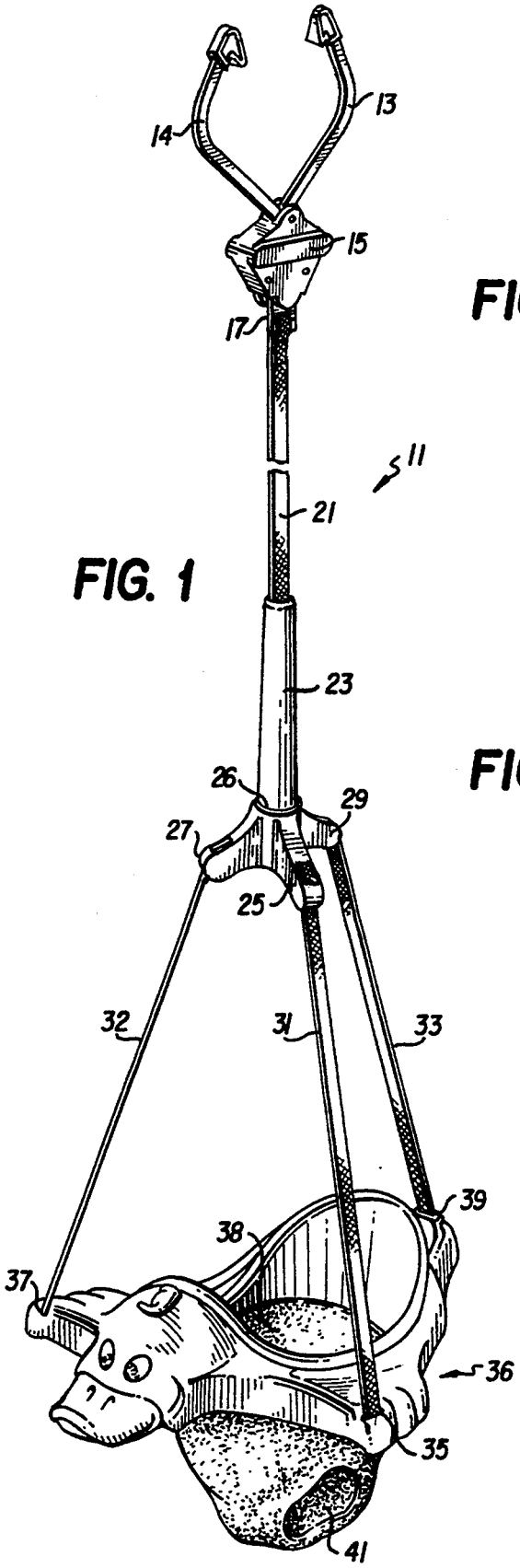
FIG. 1 is a perspective view of one embodiment of the present invention.

Referring to FIG. 1, there is shown a preferred embodiment of doorway exerciser 11. Exerciser 11 includes a scissor-type clamp having arms 13 and 14 with housing 15 enclosing a spring (not shown) urging the arms in the direction wherein they meet. The spring mechanism is similar to that illustrated in the above-identified application. The upper ends of arms 13 and 14 terminate in jumper hooks. Slotted plate 17 is secured within and depends from housing 15.

Strap 21 passes through slotted plate 17 and is adjustable within the slots so as to permit variation in the effective length of the strap. Strap 21 extends downwardly and into tube 23. The details of tube 23 will be discussed as the description proceeds. Tube 23 is preferably molded of a sturdy plastic or the like and has integral therewith ears 25, 27, and 29. Straps 31, 32, and 33 are removably secured within slots 28 and 30 of each of ears 25, 27, and 29 and the ends of the straps extend downwardly to be removably secured to seat support member 36, as described in detail below. Flexible seat member 38 subtends below support member 36 and includes the necessary leg holes (not shown).

The jumper hooks at the ends of arms 13 and 14 rest on the molding of a door (not shown) so as to secure the exerciser above the doorway.

Figure 3:
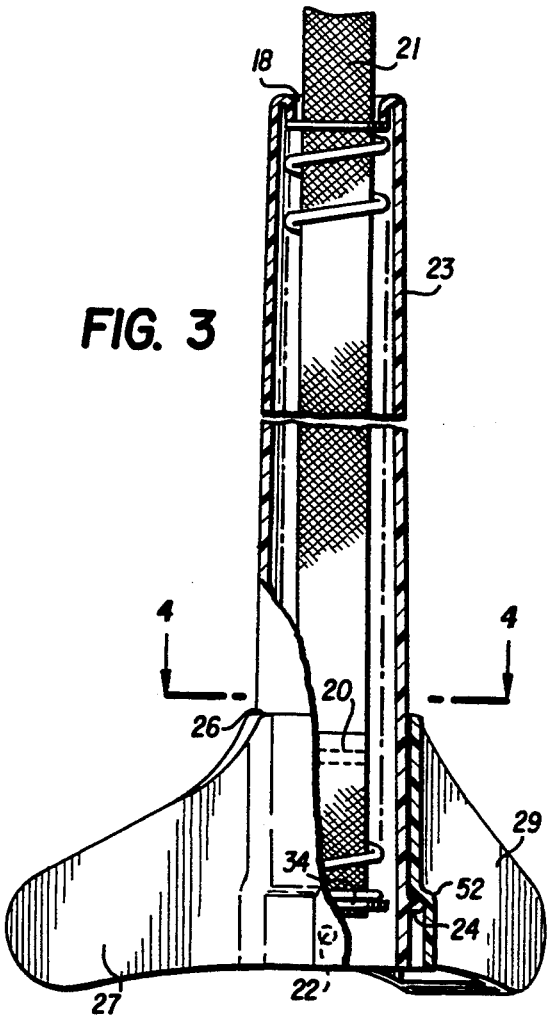
FIG. 3 is a partial sectional view of the structure of FIG. 2 in assembled condition.
Figure 2:
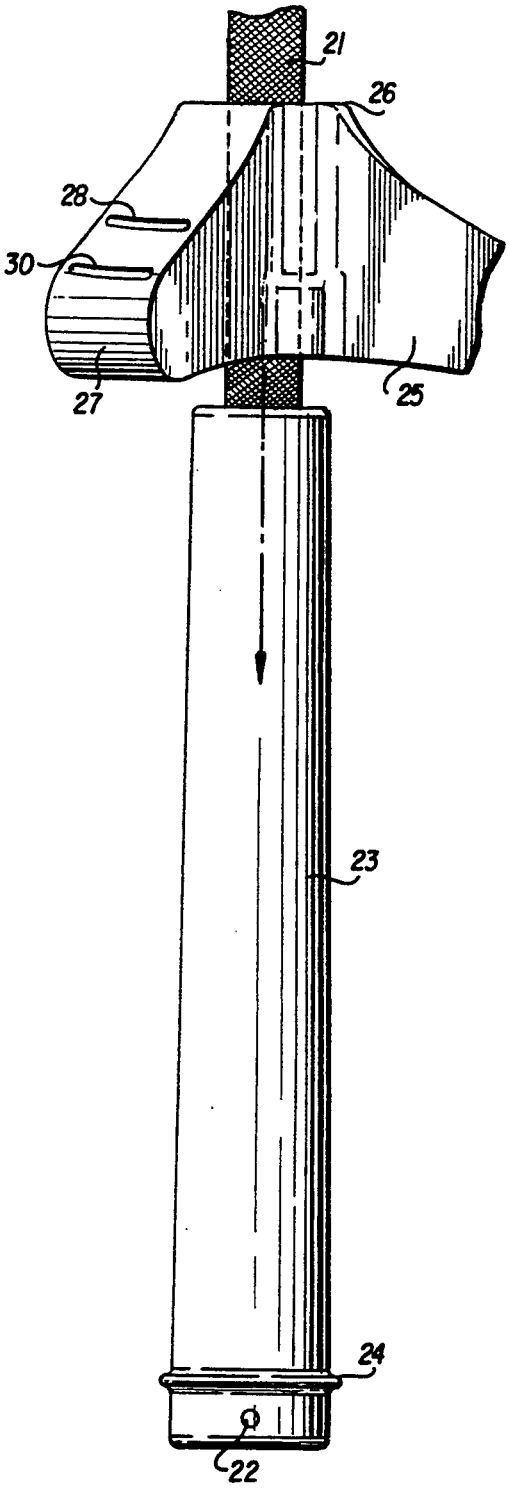
FIG. 2 is an enlarged partial plan view of the strap support structure.

FIG. 2 is a partial view of tube 23 with cylindrical member 26 and integral ears 25, 27, and 29 in a position over the tube. Cylindrical member 26 has an interior diameter slightly greater than the outer diameter of the upper end of tube 23. This permits member 26 and the associated ears to pass downwardly over tube 23 to the position shown in FIG. 3. Tube 23 includes circumferential lip 24 at its lower end. Cylindrical member 26 includes a plurality of shoulders 28 whose interior surfaces abut with lip 24 so as to limit the downward movement of member 26. As shown in FIG. 3, tube 23 increases in diameter from its upper end to its lower end so as to provide a frictional fit between the tube and cylindrical member 26 when it rests on lip 24. Spring 20 has an outer diameter greater than the inner diameter of flange 18 at the upper end of tube 23 so as to limit movement of the spring. Spring 20 is secured at the bottom of tube 23 by means of plate 34 and abutting pin 22, which is secured between opposite walls of tube 23. Belt 21 passes through dual slots in plate 34, FIG. 4, and the end is secured to the belt by means such as stitching 20.

Figure 4:
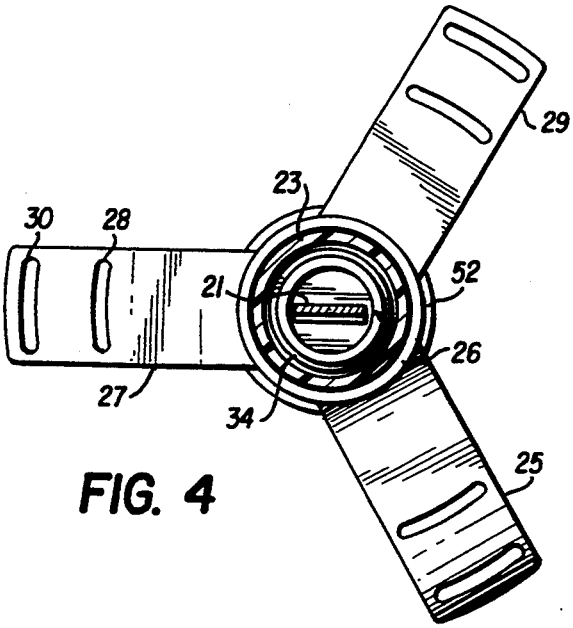
FIG. 4 is a sectional view taken through the lines 4—4 of FIG. 3.

As shown in FIGS. 2 and 4, each of ears 25, 27, and 29 includes two parallel slots 28 and 30. These slots are used to support the belt, which in turn supports the child seat below tube 23. Since all three ears are substantially identical, the following discussion, while limited to a single ear, will be understood to be descriptive of all three.

Figure 5:
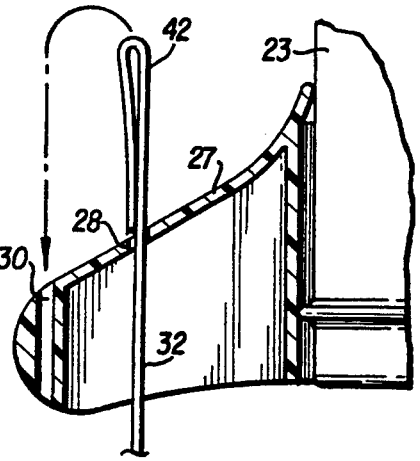
FIGS. 5–7 are partial sectional views of the strap support structure illustrating assembly thereof.
Figure 6:
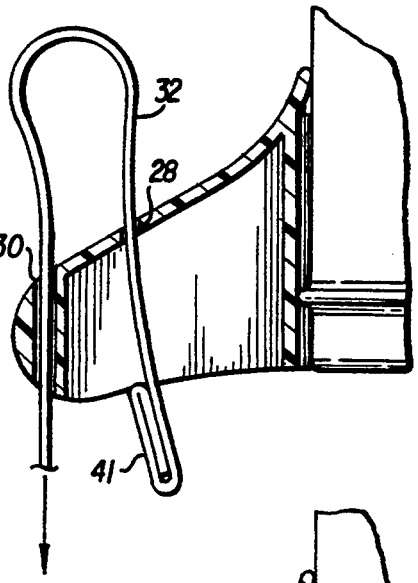
Figure 7:
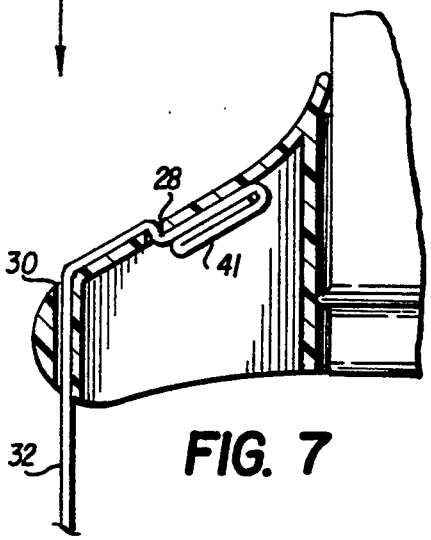

Referring to FIGS. 5, 6, and 7, a partial sectional view of ear 27 is illustrated in its operating position on tube 23. In this sectional view, shoulders 28 do not appear. One end of belt 32 is sewn to itself so as to create loop 42. Loop 42 is passed upwardly through slot 28 and passed downwardly through slot 30, as indicated by the arrows. As belt 32 is pulled upwardly as indicated in FIG. 6, and the other end of the belt is pulled downwardly. End 41, which is triple folded and secured by means such as stitching, passes upwardly until it fits against the underside of ear 27, as shown in FIG. 7. This acts as a stop so as to prevent further movement of core 32. The triple folding of end 41 prevents movement through slot 28.

Figure 9:
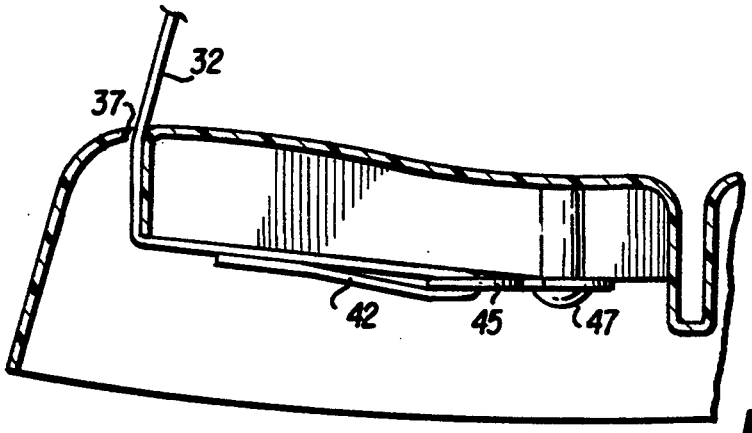
FIG. 9 is a partial sectional view taken through the lines 9—9 of FIG. 8.

FIG. 9 shows the underside of one of the sections of the seat. The section includes slots 35, 37, and 39, as indicated in FIG. 1. Again, since the securing of the belt to the seat is the same for all three connections, only one connection will be described.

Figure 8:
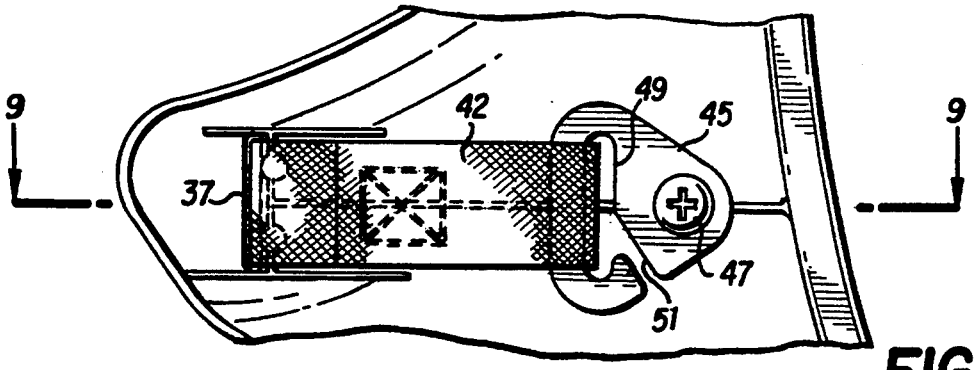
FIG. 8 is a partial bottom view of the infant seat support.

Referring to FIGS. 8 and 9, there is shown a partial bottom view of one of the sections, FIG. 8, and a cross-sectional view through that section, FIG. 9. As shown in these figures, loop 42 at the end of belt 32 is passed downwardly through slot 37. Plate 45 is rotatably secured to the underside of the seat by means such as screw 47. Plate 45 includes elongated slot 49 mating with access slot 51. When loop 42 is passed through slot 37 it is then slipped over inner slot 49 through access slot 51 so as to secure it in slot 49. Plate 45 is not shown in cross-section in the illustration of FIG. 9.

The use of the three-strap support arrangement for the infant seat improves the stability of the seat and the support structure itself so as to avoid any possible tilting of the seat which might cause discomfort or injury to the infant.

A further advantage of the present invention, including the removable cylindrical member, is that it permits the consumer to easily assemble and disassemble the product, and further allows the manufacturer to eliminate the labor costs associated with the device so as to provide a lower-priced product. Additionally, it reduces the packaging problems as far as the disassembled product is concerned.

The above description and drawings are illustrative only since equivalent components could be used without departing from the invention, which is to be limited only by the scope of the following claims.

I claim:

1. A doorway exerciser comprising clamping means adapted to fit above a doorway framework;

strap means secured to said clamping means at one end thereof;

a substantially rigid tube having a reduced opening at one end thereof;

a compression spring within said tube, said spring having an outer diameter greater than the diameter of said reduced opening at said one end of said tube;

a slotted plate abutting the end of said spring opposite said reduced opening;

the other end of said strap means passing into said reduced opening of said tubing, through said spring and said slots in said slotted plate and secured to itself;

a seat support means;

a cylindrical member frictionally mounted about said rigid tube;

three substantially equally spaced ears integral with an extending outwardly from said cylindrical member;

a separate flexible strap removably secured at one end to each of said ears; and means for removably securing the other end of each of said flexible straps to said seat support means.

2. The doorway exerciser of claim 1 further comprising means for adjusting the length of said strap means.

3. The doorway exerciser of claim 1 wherein said other ends of said flexible straps are substantially equally spaced about the periphery of said seat support means.

4. The doorway exerciser of claim 1 further comprising a circumferential lip adjacent one end of said rigid tube; and an internal shoulder within said cylindrical member mating with said circumferential lip so as to limit the axial movement of said cylindrical member along said tube.

* * * * *